US007111538B2

(12) United States Patent
Kitamura

(10) Patent No.: US 7,111,538 B2
(45) Date of Patent: Sep. 26, 2006

(54) DOUBLE ACTING CAM DIE

(75) Inventor: Noritoshi Kitamura, Hirakata (JP)

(73) Assignee: Umix Co., Ltd., Osaka (JP)

( * ) Notice: Subject to any disclaimer, the term of this patent is extended or adjusted under 35 U.S.C. 154(b) by 22 days.

(21) Appl. No.: 10/885,646

(22) Filed: Jul. 8, 2004

(65) Prior Publication Data

US 2005/0103177 A1 May 19, 2005

(30) Foreign Application Priority Data

Nov. 14, 2003 (JP) ..... 2003-384825

(51) Int. Cl.
*B26D 5/16* (2006.01)

(52) U.S. Cl. ..... 83/638; 83/554; 83/627

(58) Field of Classification Search ..... 83/627, 83/638, 554, 555
See application file for complete search history.

(56) References Cited

U.S. PATENT DOCUMENTS 3,893,361 A * 7/1975 Harris ..... 83/375
4,534,255 A * 8/1985 Salvagnini ..... 83/530
5,101,705 A * 4/1992 Matsuoka ..... 83/588
5,931,074 A * 8/1999 Matsuoka ..... 83/588
6,220,137 B1 * 4/2001 Matsuoka ..... 83/627
6,715,392 B1 * 4/2004 Zscheile ..... 83/638

* cited by examiner

*Primary Examiner*—Charles Goodman
(74) *Attorney, Agent, or Firm*—Birch, Stewart, Kolasch & Birch, LLP

(57) ABSTRACT

In order to process by the same step even if the processing directions are different, reduce the number of the constituting parts of the die required for all the steps of the press dying as much as possible, easily design, and easily respond to the design change a double acting cam die comprising a slide cam base, a slide cam guided by the slide cam base and having a first processing member mounted thereto. An energizing body which is interposed between the slide cam base and the slide cam so as to energize the slide cam. An actuating cam which is brought into contact with the slide cam base and the slide cam so as to drive the slide cam, and has a second processing member mounted thereto. A guiding member which guides the actuating cam, and an energizing body which is interposed between the guiding member and the actuating cam so as to energize the actuating cam. An angle of processing incline of the second processing member is brought into line with an angle of cam incline of the slide cam base.

12 Claims, 3 Drawing Sheets

DOUBLE ACTING CAM DIE

This Non-provisional application claims priority under 35 U.S.C. § 119(a) on patent application No(s). 2003-384825 filed in Japan on Nov. 14, 2003, the entire contents of which are hereby incorporated by reference.

BACKGROUND OF THE INVENTION

1. Field of the Invention

The present invention relates to a double acting cam die which can process in different processing directions by using a first processing member and a second processing member.

2. Description of Background Art

A press dying includes a drawing process in a first step, a trimming process in a second step, a piercing process in a specific direction in a third step, a piercing process in a different specific direction from the specific direction in a fourth step, and the like.

Even in the same piercing process, if the processing direction is different, it is impossible to process in the same step.

Further, in the press dying, the number of constituting parts of a die required for all the steps of the press dying is fixed. In the process having an angle of incline, three members comprising a slide cam base, a slide cam and an actuating cam are required as the constituting parts.

Further, each time the angle of incline for the processing is different, a new design is executed.

Even in the same piercing process, if the processing direction is different, it is impossible to process in the same process. Accordingly, it is required to execute the processes in the different processing directions by the same step.

Further, in the process having the angle of incline, since three members comprising the slide cam base, the slide cam and the actuating cam are required as the constituting parts, it is required to reduce the number of the constituting parts of the die required for all the steps of the press dying.

Further, since the new design is executed each time the angle of incline for the processing is different, it is required to easily design and easily respond to the design change.

SUMMARY OF THE INVENTION

Accordingly, taking the matter mentioned above into consideration, in order to process by the same step even if the processing directions are different, reduce the number of the constituting parts of the die required for all the steps of the press dying as much as possible, easily design, and easily respond to the design change, in accordance with the present invention, there is provided a double acting cam die comprising a slide cam base, a slide cam which is guided by the slide cam base and has a first processing member such as a punch or the like mounted thereto, an energizing body which is interposed between the slide cam base and the slide cam so as to energize the slide cam, an actuating cam which is brought into contact with the slide cam base and the slide cam so as to drive the slide cam, and has a second processing member such as a punch or the like mounted thereto, a guiding member which guides the actuating cam, and an energizing body which is interposed between the guiding member and the actuating cam so as to energize the actuating cam, wherein an angle of processing incline of the second processing member is brought into line with an angle of cam incline of the slide cam base.

Further, in accordance with a specific aspect of the present invention, there is provided a double acting cam die, wherein the actuating cam hangs from the guiding member and is slidably provided on the guiding member.

Further, in accordance with a specific aspect of the present invention, there is provided a double acting cam die, wherein a wear plate is provided on each of sliding surfaces between the slide cam and the slide cam base.

Further, in accordance with a specific aspect of the present invention, there is provided a double acting cam die, wherein a wear plate is interposed on a sliding surface between the slide cam and the guiding member.

In addition, in accordance with a specific aspect of the present invention, there is provided a double acting cam die, wherein the energizing body is constituted by a gas spring.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

EMBODIMENT

A detailed description of the present invention will be given below on the basis of a specific embodiment shown in the accompanying drawings.

Figure 1:
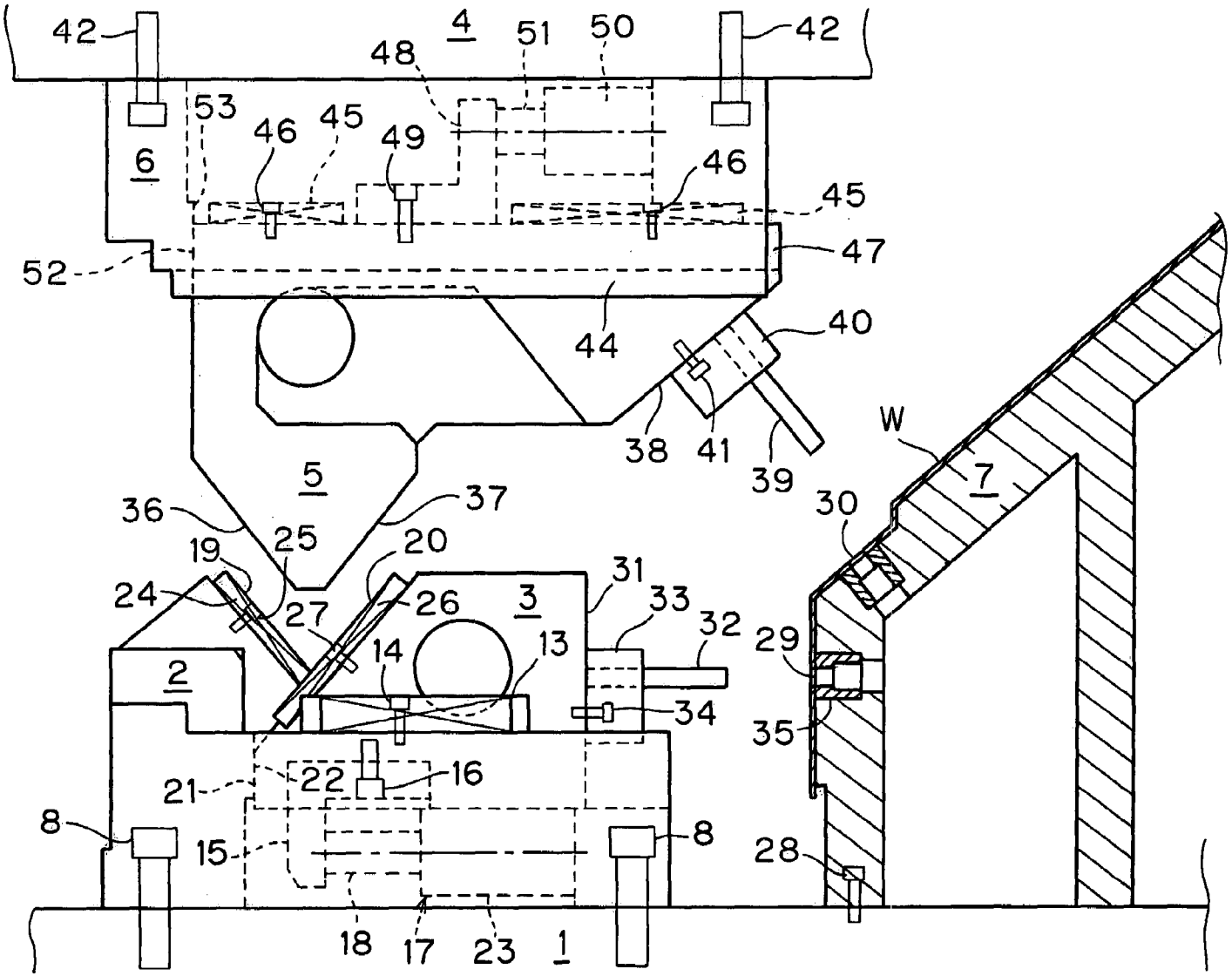
FIG. 1 is a front elevational view showing a cross section of a part of a double acting cam die in accordance with the present invention in a state of a top dead center.
Figure 2:
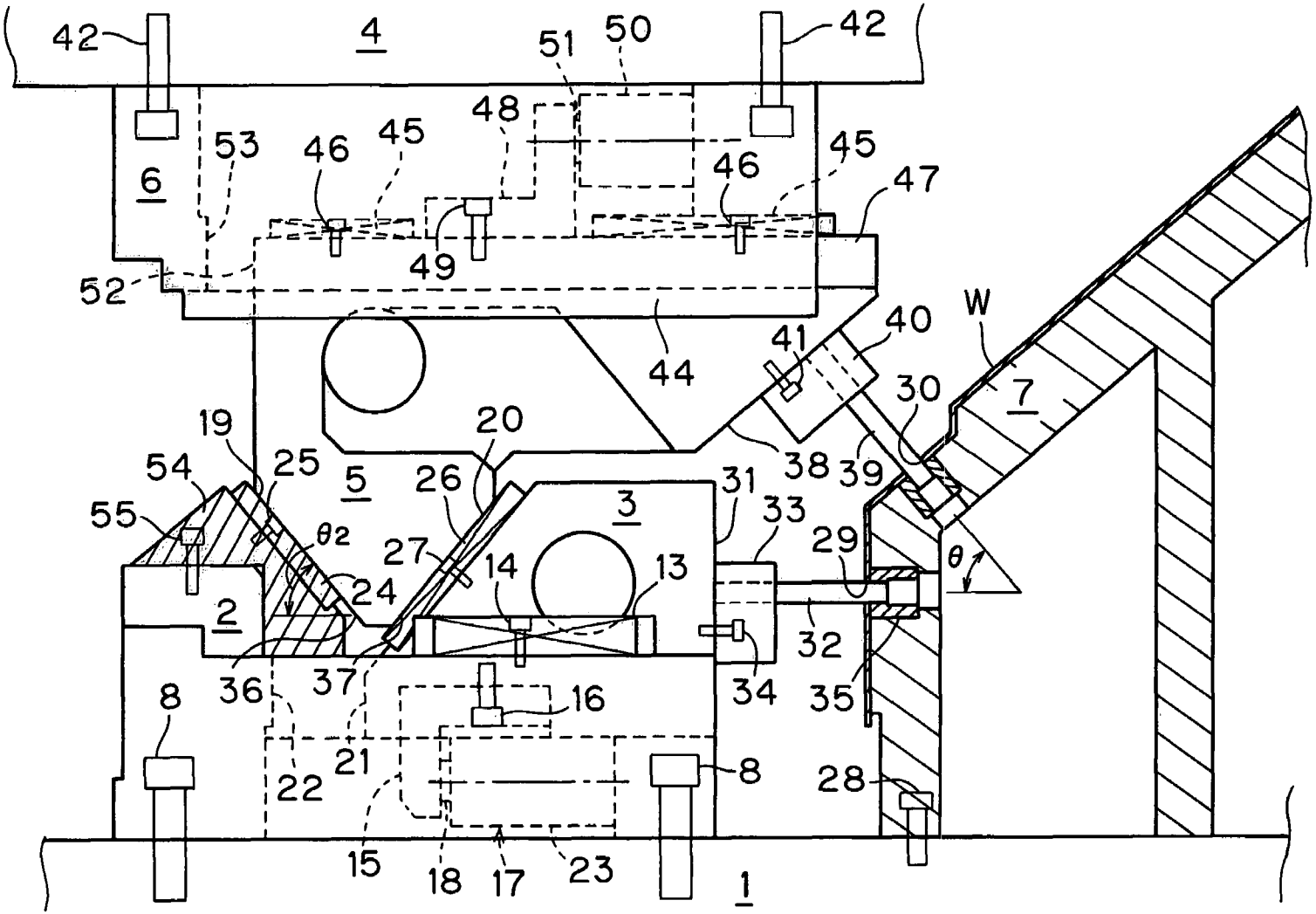
FIG. 2 is a front elevational view showing a cross section of a part of the double acting cam die in accordance with the present invention in a state of a bottom dead center.
Figure 3:
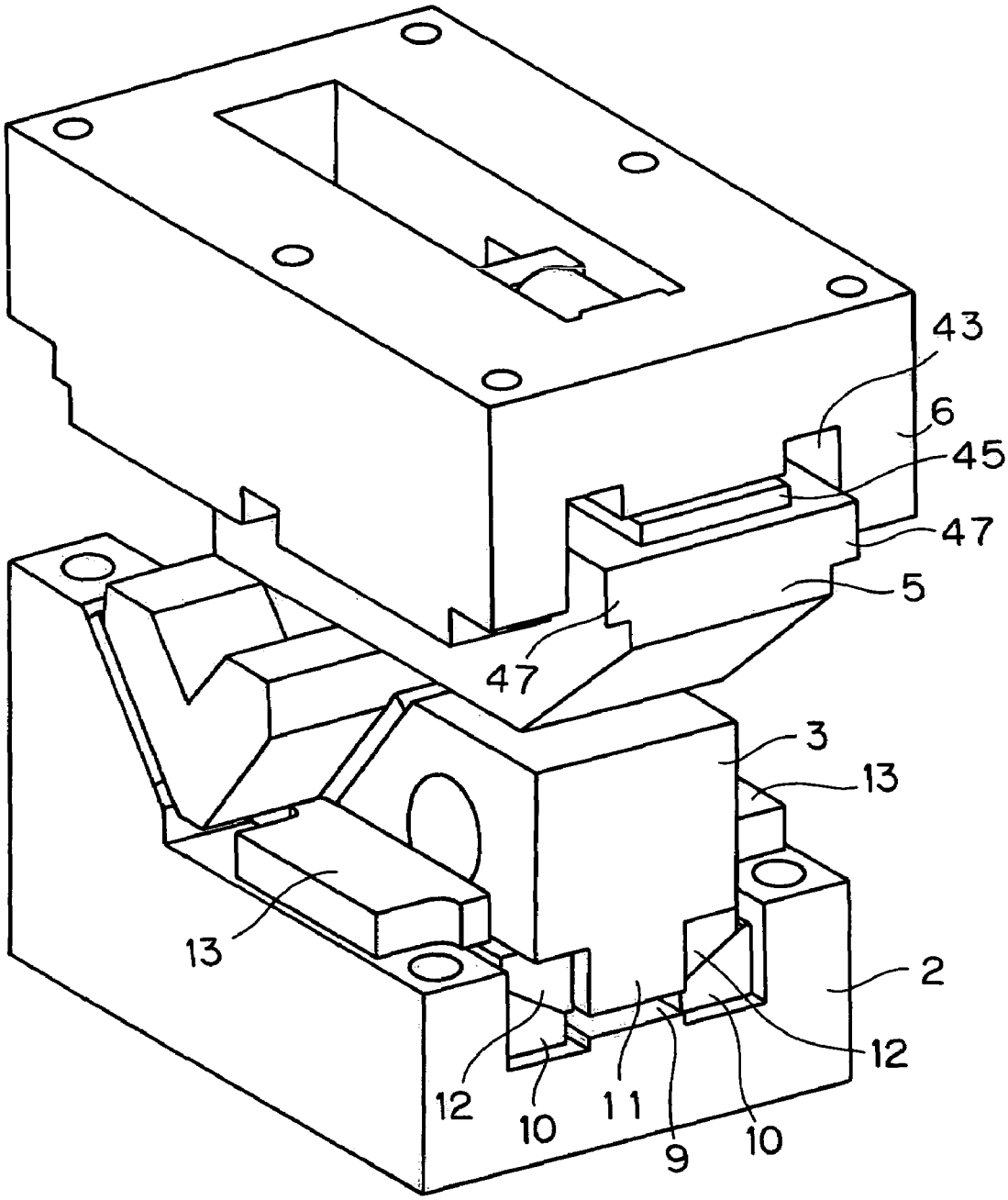
FIG. 3 is a perspective view of the double acting cam die in accordance with the present invention in the state of the bottom dead center.

FIG. 1 is a front elevational view showing a cross section of a part of the present double acting cam die in a state of a top dead center, FIG. 2 is a front elevational view showing a cross section of a part of the present double acting cam die in a state of a bottom dead center, and FIG. 3 is a perspective view of the present double acting cam die in the state of the bottom dead center.

A lower die main body 1 is provided with a slide cam base 2, a slide cam 3 which is guided by the slide cam base 2 and has a first processing member such as a punch or the like mounted thereto, an energizing body which is interposed between the slide cam base 2 and the slide cam 3 so as to energize the slide cam 3, and a supporting member 7.

An upper die main body 4 is provided with an actuating cam 5 which is brought into contact with the slide cam base 2 and the slide cam 3 so as to drive the slide cam 3, and has a second processing member such as a punch or the like mounted thereto, a guiding member 6 which guides the actuating cam 5, and an energizing body which is interposed between the guiding member 6 and the actuating cam 5 so as to energize the actuating cam 5. Reference symbol W denotes a work.

The slide cam base 2 is firmly fixed to the lower die main body 1 by bolts 8.

Wear plates 10 structuring sliding surfaces; formed in an inward downward slope and having a trapezoidal cross section are firmly fixed to both side bottom portions of a groove 9 guiding the slide cam 3 of the slide cam base 2.

The slide cam 3 is structured such that a protruding piece 11 having a rectangular cross section protrudes toward a lower side, sliding surfaces are formed on both sides of the protruding piece 11, and wear plates 12 that are formed having an outward upward slope and have a trapezoidal cross section are firmly fixed to the both sides. The wear plates 12 slide on the wear plates 10.

A side end portion of the wear plate 12 protrudes toward an outer side from a side surface of the slide cam 3. A lower surface of the guide plate 13 is brought into contact with an upper surface of an outward protruding portion of the wear plate 12. The guide plate 13 is firmly fixed to the slide cam base 2 by bolts 14.

The slide cam 3 slides on the slide cam base 2 in the manner mentioned above. Further, the wear plate 10 having the inward downward slope is firmly fixed to the slide cam base 2, and the wear plate 12 having the outward upward slope and sliding on the wear plate 10 is firmly fixed to the slide cam 3. Accordingly, the slide cam 3 is urged to a center side and accurately slides.

A bracket 15 is firmly fixed to a bottom surface of the slide cam 3 by a bolt 16, and a leading end of a rod 18 of a gas spring 17 having a base end firmly fixed to the slide cam base 2 is brought into contact with the bracket 15. As long as the actuating cam 5 is moved downward so as to be brought into contact with a cam slope surface 19 of the slide cam base 2 and a cam slope surface 20 of the slide cam 3, the rod 18 of the gas spring 17 is contracted, however, in accordance with an upward movement of the actuating cam 5, the rod 18 of the gas spring 17 is gradually extended, whereby the slide cam 3 is not brought into contact with the cam slope surface 19 of the slide cam base 2 and the cam slope surface 20 of the slide cam 3. Then, the rod 18 of the gas spring 17 is extended so as to bring a rear end surface 21 of the slide cam 3 into contact with a stop surface 22 of the slide cam base 2. Accordingly, the slide cam 3 stops.

The gas spring 17 is structured such that a high pressure gas in correspondence to an intended use, for example, a high pressure gas of 150 kgf/cm$^2$ is received within a cylinder 23, and an approximately uniform output, for example, 150 kgf/cm$^2$ can be obtained all the length of a rod contraction stroke even in the case that the rod 18 protruding from the cylinder 23 is expanded and contracted. Two tanks are installed within the cylinder 23, however, when the rod 18 is contracted and the pressure is applied to one tank, the high pressure gas flows out from one tank so as to flow into another tank, whereby the approximately uniform output (the output may be slightly increased due to compression) can be obtained all the stroke of the rod 18.

As mentioned above, in the gas spring 17, the high output can be obtained all the stroke from the operation start as is different from the coil spring, where by it is possible to securely return the slide cam 3 and a safety operation can be achieved.

Further, in accordance with the gas spring 17, it is possible to move the slide cam 3 for a long distance, and it is possible to process a thin plate formed product of a motor vehicle constituted by a large-size work.

In this case, a wear plate 24 is firmly fixed to the slide cam base 2 by a bolt 25, a wear plate 26 is firmly fixed to the slide cam 3 by a bolt 27.

The work W is mounted on the supporting member 7 which is fixed to the lower die main body 1 by a bolt 28. A first hole 29 and a second hole 30 are pierced on the work W. An angle $\theta_1$ of incline for processing a first processing member is 0 degree, and an angle $\theta_2$ of incline for processing a second processing member is 50 degree. The first hole 29 is formed on a vertical surface of the work W.

Both the first processing member and the second processing member are exemplified by the piercing in the present embodiment, however, the present invention is not limited to this, and includes a notching, a forming and the other processing.

The matter that the angle $\theta_1$ of incline for processing the first processing member is 0 means that a first processing member mounting surface 31 of the slide cam 3 is a vertical surface. A punch plate 33 holding a punch 32 is firmly fixed to the first processing member mounting surface 31 by a bolt 34 in such a manner as to rise up while opposing to the first hole 29.

The first hole 29 forms a hole by the punch 32 and a die bush 35 buried in the supporting member 7.

The actuating cam 5 has a slope surface 36 which is brought into contact with the cam slope surface 19 of the slide cam base 2, and a slope surface 37 which is brought into contact with the cam slope surface 20 of the slide cam 3.

The actuating cam 5 has a second working member mounting surface 38 in addition to the slope surfaces 36 and 37. The angle $\theta_2$ of incline for processing the second processing member is 50 degree, and in order to pierce the second hole 30 of the work W, a punch 39 is raised up by a punch holder 40 so as to be orthogonal to the second hole 30, and the punch holder 40 is firmly fixed to the second working member mounting surface 38 by a bolt 41. An angle of incline of the cam slope surface of the slide cam base 2 is set to 50 degree which is equal to the angle $\theta_2$ of incline for processing the second processing member such that the punch 39 moves in a direction of processing the second member having the angle $\theta_2$ of incline for processing the second member.

The guide member 6 for guiding the actuating cam 5 is firmly fixed to the upper die main body 4 by a bolt 42.

A groove 43 for guiding the actuating cam 5 of the guiding member 6 is provided, the upper portion of the actuating cam 5 is inserted into the groove 43, and a suspended piece 47 protrudes toward an upper side portion of the actuating cam 5 so as to be slidably hung on a supporting piece 44 of the guiding member 6. A wear plate 45 is firmly fixed to an upper surface of the guiding member 6 by a bolt 46.

A bracket 48 is firmly fixed to an upper surface of the actuating cam 5 by a bolt 49, and a leading end of a rod 51 of a gas spring 50 having a base end firmly fixed to the guiding member 6 is brought into contact with the bracket 48. As long as the actuating cam 5 is moved downward so as to be brought into contact with a cam slope surface 19 of the slide cam base 2 and a cam slope surface 20 of the slide cam 3, the rod 51 of the gas spring 50 is contracted, however, in accordance with an upward movement of the actuating cam 5, the rod 51 of the gas spring 50 is gradually extended, whereby the slide cam 3 is not brought into contact with the cam slope surface 19 of the slide cam base 2 and the cam slope surface 20 of the slide cam 3. Then, the rod 51 of the gas spring 50 is extended so as to bring a rear end surface 52 of the actuating cam 5 into contact with a stop surface 53 of the guiding member 6. Accordingly, the actuating cam 5 stops.

When the work W is pierced, it is necessary to apply a process to a hole forming surface of the work W from a vertical direction. In the case that the angle $\theta_1$ of incline for processing the first processing member is 0 and the angle $\theta_2$ of incline for processing the second working member is 50 degree as in the present embodiment, the actuating cam which has been conventionally firmly fixed is set movable, the actuating cam 5 moves the slide cam 3 in a direction of processing the first processing member, the slide cam 3 is moved in the direction of processing the second processing member ($\theta_2$=50 degree) on the basis of the angle 19 of incline of the cam in the slide cam base 2 ($\theta_2$=50 degree), and the second hole 30 is pierced, although the hole can not be processed in the same step conventionally.

The angle $\theta_1$ of incline for processing the first processing member includes 0 degree, 10 degree, 20 degree and the like, and the angle $\theta_2$ of incline for processing the second processing member includes 40 degree, 50 degree, 60 degree, 70 degree, 80 degree and the like. Various combinations between the angle $\theta_1$ of incline for processing the first processing member and the angle $\theta_2$ of incline for processing the second processing member can be considered. For example, there are combinations 0 degree–40 degree, 0 degree–50 degree, 0 degree–60 degree, 10 degree–50 degree, 10 degree–60 degree, 10 degree–70 degree, 20 degree–60 degree, 20 degree–70 degree, and 20 degree–80 degree (the former indicates $\theta_1$, and the latter indicates $\theta_2$). The design can be easily carried out by standardizing them, and the design change can be easily addressed.

Setting the angle $\theta_1$ of incline for processing the first processing member to 0 degree, 10 degree and 20 degree means arranging the first processing member mounting surface 31 so as to correspond to the angle $\theta_1$ of incline of 0 degree, 10 degree and 20 degree. $\theta_1$=0 degree corresponds to an illustrated state, and $\theta_1$=10 degree corresponds to a state in which an upper side and a lower side are positioned respectively to the right and the left with respect to the state of $\theta_1$=0 degree so as to be inclined at 10 degree.

In order to set the angle $\theta_2$ of incline for processing the second processing member to 40 degree, 50 degree, 60 degree, 70 degree and 80 degree, it is preferable to form the second processing member mounting surface 38 so as to correspond to the angle $\theta_2$ of incline of 40 degree, 50 degree, 60 degree, 70 degree and 80 degree. $\theta_2$=50 degree corresponds to an illustrated state, and $\theta_2$=40 degree, 50 degree, 60 degree, 70 degree and 80 degree requires reshaping a new actuating cam 3. It is necessary to change the slide cam base 2 in correspondence to the angle $\theta_2$ of incline. In order to easily achieve the change, a hatched replacement member 54 of the slide cam base 2 is structured so as to be replaceable. The replacement member 54 in which the cam slope surface 19 matches to the angle $\theta_2$ is used.

In the conventional piercing process, three members comprising the slide cam base, the slide cam and the actuating cam are required, and in the case that the piercing process is executed by two steps, three pieces×2=6 pieces of members are required.

In this case, in accordance with the present invention, since the piercing process which has been conventionally executed in two steps is executed in one step, the required member can be processed by four members comprising the guiding member in addition to the slide cam base, the slide cam and the actuating cam. In accordance with the present invention, the number of the members can be reduced and a cost reduction can be achieved.

The present invention can be applied to a notching process, a bending process, a forming process and the other press dying process in addition to the piercing in the different processing directions.

Since the present invention provides the double acting cam die comprising the slide cam base, the slide cam which is guided by the slide cam base and has the first processing member such as the punch or the like mounted thereto, the energizing body which is interposed between the slide cam base and the slide cam so as to energize the slide cam, the actuating cam which is brought into contact with the slide cam base and the slide cam so as to drive the slide cam, and has the second processing member such as the punch or the like mounted thereto, the guiding member which guides the actuating cam, and the energizing body which is interposed between the guiding member and the actuating cam so as to energize the actuating cam, it is possible to process in the same step even in the case that the processing directions are different, it is possible to reduce the number of the constituting parts of the die required for all the steps of the press dying, the design can be easily executed, and it is possible to easily correspond to the design change.

Further, in accordance with the specific aspect of the present invention, the actuating cam hangs from the guiding member and is slidably provided on the guiding member.

Further, in accordance with the specific aspect of the present invention, the wear plate is provided on each of the sliding surfaces between the slide cam and the slide cam base.

Further, in accordance with the specific aspect of the present invention, the wear plate is interposed on the sliding surface between the slide cam and the guiding member.

In addition, in accordance with the specific aspect of the present invention, the energizing body is constituted by the gas spring.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A double acting cam die, comprising:

a slide cam base having a cam slope surface;

a slide cam, said slide cam being guided by the slide cam base and having a first processing member mounted thereto;

a first energizing body, said first energizing body being interposed between the slide cam base and the slide cam so as to energize the slide cam;

an actuating cam, said actuating cam being brought into contact with the slide cam base and the slide cam so as to drive the slide cam and having a second processing member mounted thereto;

a guiding member, said guiding member guiding the actuating cam; and a second energizing body, said second energizing body being interposed between the guiding member and the actuating cam, wherein a processing angle of the second processing member is the same as an incline angle of the cam slope surface of the slide cam base.

2. The double acting cam die as claimed in claim 1, wherein the actuating cam hangs from the guiding member and is slidably provided on the guiding member.

3. The double acting cam die as claimed in claim 1, wherein a wear plate is provided on each of sliding surfaces between the slide cam and the slide cam base.

4. The double acting cam die as claimed in claim 1, wherein a wear plate is interposed on a sliding surface between the actuating cam and the guiding member.

5. The double acting cam die as claimed in claim 1, wherein the first and second energizing bodies are constituted by a gas spring.

6. The double acting cam die as claimed in claim 1, wherein said first and second processing members are punches.

7. A double acting cam die, comprising: a slide cam base;

a slide cam, said slide cam being guided by the slide cam base and having a first processing member mounted thereto, said first processing member being movable in a first processing direction;

a first energizing body, said first energizing body being interposed between the slide cam base and the slide cam so as to energize the slide cam;

an actuating cam, said actuating cam being brought into contact with the slide cam base and the slide cam so as to drive the slide cam and having a second processing member mounted thereto, said second processing member being movable in a second processing direction;

a guiding member, said guiding member guiding the actuating cam; and a second energizing body, said second energizing body being interposed between the guiding member and the actuating cam, wherein said first processing direction is different from said second processing direction.

8. The double acting cam die as claimed in claim 7, wherein the actuating cam hangs from the guiding member and is slidably provided on the guiding member.

9. The double acting cam die as claimed in claim 7, wherein a wear plate is provided on each of sliding surfaces between the slide cam and the slide cam base.

10. The double acting cam die as claimed in claim 7, wherein a wear plate is interposed on a sliding surface between the actuating cam and the guiding member.

11. The double acting cam die as claimed in claim 7, wherein the first and second energizing bodies are constituted by a gas spring.

12. The double acting cam die as claimed in claim 7, wherein said first and second processing members are punches.

* * * * *